US008956042B2

(12) United States Patent
Cornibé et al.

(10) Patent No.: US 8,956,042 B2
(45) Date of Patent: Feb. 17, 2015

(54) TIMEPIECE MOVEMENT WITH POWER RESERVE FOR EXTENDED OPERATION

(71) Applicant: Audemars Piguet (Renaud et Papi) SA, Le Locle (CH)

(72) Inventors: Sylvain Cornibé, Les Combes (FR); Eddy Valladon, Paris (FR)

(73) Assignee: Audemars Piguet (Renaud et Papi) SA, Le Locle (CH)

( * ) Notice: Subject to any disclaimer, the term of this patent is extended or adjusted under 35 U.S.C. 154(b) by 0 days.

(21) Appl. No.: 13/973,067

(22) Filed: Aug. 22, 2013

(65) Prior Publication Data

US 2014/0056113 A1 Feb. 27, 2014

(30) Foreign Application Priority Data

Aug. 23, 2012 (EP) ..... 12181455

(51) Int. Cl.
*G04B 1/16* (2006.01)
*G04B 1/22* (2006.01)
*G04B 9/00* (2006.01)

(52) U.S. Cl.
CPC .. *G04B 1/16* (2013.01); *G04B 1/22* (2013.01); *G04B 9/00* (2013.01)
USPC ..... 368/142; 368/148

(58) Field of Classification Search
CPC ..... G04B 1/16; G04B 1/22; G04B 9/00
USPC ..... 368/140, 142, 143, 148, 208
See application file for complete search history.

(56) References Cited

U.S. PATENT DOCUMENTS

| | | | | |
|---|---|---|---|---|
| 2,783,657 | A | 3/1957 | Kohlhagen | |
| 3,177,975 | A | 4/1965 | Galli | |
| 3,878,673 | A * | 4/1975 | Meitinger | 368/209 |
| 6,422,739 | B1 * | 7/2002 | Hara et al. | 368/209 |
| 6,587,401 | B2 * | 7/2003 | Rebeaud et al. | 368/204 |

FOREIGN PATENT DOCUMENTS

| | | |
|---|---|---|
| CH | 693 155 A5 | 3/2003 |
| EP | 1 914 604 | 4/2008 |
| EP | 2 455 820 A2 | 5/2012 |

* cited by examiner

*Primary Examiner* — Vit W Miska
(74) *Attorney, Agent, or Firm* — Drinker Biddle & Reath LLP

(57) ABSTRACT

A mechanical timepiece movement, including a spiral spring, a barrel, the spiral spring accommodated in the barrel as an energy storage, the barrel transmitting energy of the spiral spring by a gear train to an oscillator, the oscillator including a balance as a regulating device, and a mechanism configured to reduce a torque generated by the barrel to reduce loss of energy stored in the spiral spring.

16 Claims, 8 Drawing Sheets

TIMEPIECE MOVEMENT WITH POWER RESERVE FOR EXTENDED OPERATION

CROSS-REFERENCE TO RELATED APPLICATIONS

This application claims the benefit of European Patent Application Serial No. 12181455.2, dated Aug. 23, 2012, the entire contents of which is incorporated herein by reference.

TECHNICAL FIELD

This invention relates to a timepiece movement with power reserve for extended operation, for example mounted in a mechanical watch. In particular, the invention aims to provide mechanical watches, for example wristwatches, chronographs and other, automatically winding or manually winding, watches, preferably reputable watches, with a system that makes it possible to double or extend even further the duration of the operational power reserve.

BACKGROUND ART

In mechanical watches, the source of energy for driving the gear train and the hands, including the date display, is a wound spiral spring in a barrel.

When a mechanical watch is not wound regularly, or a watch with automatic winding has not been worn for several hours, the watch spring relaxes completely and the watch stops. This is all the more disagreeable because not only does the hour display stop, but also the date indication by way of the wheel or wheels of the calendar. The average operational power reserve of a normal watch is completely used up, i.e. when the watch is wound well, in about 40 to 60 hours.

There are several reasons for a watch to discharge its energy until it stops totally. The main reasons are, on the one hand, non-use of the watch (it is left in a box, it is not worn on the weekend, etc.) or just simply one has forgotten to wind it, in the case of non-automatic watches. It is thus highly desirable to have watches provided with an operational power reserve extending beyond that of known watches.

In the past, this flaw with mechanical watches has already been addressed, and a solution sought. For example, Swiss patent No. CH-693155 mentions as aim to increase the power reserve of a timepiece movement by reducing as much as possible the loss of driving torque during the first 24 or 48 hours of operation. This object is achieved by providing two barrels, having equal features, driving alternately the timepiece movement and working in turn with a blocking switch between the two barrels.

European patent application No. EP-11188982.0 (EP 2 455 820) proposes the use of a motor organ comprising a barrel in which two superimposed and coaxial springs are mounted.

These two documents cited above are just examples of watches with two barrels or two springs because there are numerous publications for these proposals. Such proposals for solving the problem of increasing operation are not very interesting because these solutions propose roughly to put in as many barrels, permitting the storage of energy, as power reserve desired. The power reserve is thus increased at the expense of the space available.

Moreover the state of the art remains silent concerning an examination of the distribution of torque in a timepiece movement, i.e. one has not yet discovered where the different energy demands are located in the movement. In contrast, the patent application holder has posed as additional the analysis of the torque, from the barrel to the hands.

SUMMARY

In one aspect of the present invention, a mechanical timepiece movement is provided. The movement preferably includes a spiral spring, and a barrel, the spiral spring accommodated in the barrel as an energy storage, the barrel transmitting energy of the spiral spring by a gear train to an oscillator, the oscillator including a balance as a regulating device. Moreover, the movement further preferably includes a mechanism configured to reduce a torque generated by the barrel to reduce loss of energy stored in the spiral spring.

According to another aspect of the present invention, a method for ensuring prolonged operation of a timepiece movement following an extended power reserve is provided. The method preferably includes the steps of determining a distribution of torques in the timepiece movement required for driving different timepiece movement elements, and selecting an element of the timepiece movement elements for which the torque needs to be reduced. Moreover, the method further preferably includes a step of reducing the selected torque to a value thereby ensuring proper operation of the timepiece movement.

According to still another aspect of the present invention, a mechanical watch is provided. The mechanical watch preferably includes a casing, and a spiral spring and a barrel located inside the casing, the spiral spring accommodated in the barrel as an energy storage, the barrel transmitting energy of the spiral spring by a gear train to an oscillator, the oscillator including a balance as a regulating device. Moreover, the mechanical watch further preferably includes a mechanism configured to reduce a torque generated by the barrel to reduce loss of energy stored in the spiral spring.

One goal of the present invention is a timepiece movement for a mechanical watch whose operational power reserve is considerably extended, and a method for achieving an increased operational power reserve. In addition, the invention also concerns a mechanical watch incorporating such a movement.

The invention aims moreover to allow the user of the watch to change manually the state of operation between normal operation and operation with prolonged power reserve. It is likewise envisaged that the current state (normal power reserve—prolonged power reserve) is indicated by the watch. Furthermore the prolonged power reserve operation must not disturb the time base.

The chronometric performance of a watch is improved when the oscillator stores a lot of energy: this renders it less sensitive to disruptions. When the watch is not worn, it can be foreseen that the energy provided to the balance is reduced in favor of the power reserve.

The applicant, first of all, has undertaken extensive research aimed at determining the distribution of torque in a timepiece movement. The different components of the gear train as well as the driving of the time display and of the date display have been investigated in detail to determine the places of maximal energy consumption. It has been found that, except for the gearing for the date, the balance requires the most energy. This is understandable because the balance must be accelerated from a stop position and against the force of a spiral spring, then it must be stopped (when the force applied is neutralized by the force of the spring), and then it returns to the initial position where it will be stopped again in order for the escapement to work.

The decrease in the energy demand of a timepiece movement is obtained, according to the invention, by a decrease in the angle of oscillation (of the amplitude) of the balance. This decrease can be obtained, according to a special embodiment of the invention, by changing the ratio of speed to level of the center barrel gearing. By increasing this ratio, the torque on the escapement wheel is reduced, and the amplitude of the balance is lowered in favor of the power reserve.

Another possibility to prolong the operational power reserve of the watch, not preferred for the time being, would be a modification of the watch spring, whose one part is used at the time of normal operation, and whose other separate part remaining disengaged is engaged when the state of "rest" is activated.

The respective and reversible changes in the ratio of the gearing between the barrel and the central wheel (the center) can be achieved in several ways. They will be described in the specification of the invention in relation to the figures.

At the time of a change in the ratio of the speed in the gear wheel in operation, it is however important to prevent a disturbance of the display and to ensure the compatibility with the existing functions of the watch. The reduction of torque is thus limited by the minimum torque necessary for driving a complicated function, for example the operation of the display of the date or the overriding of a spring. Moreover, in normal operational mode, the chronometric aspect must not be changed.

The patent application holder has also noted that the reduction of the couple transmitted to the balance has no influence on the operation of the calendar. The dates are always correctly indicated. This feature of the system according to the invention eliminates a serious disadvantage of known watches in which, after the stop of the watch following the depletion of the power reserve, the display of the date no longer follows and must be reset to the correct date, which is a time-consuming and tedious operation.

On the other hand, the working of the escapement with a balance of low amplitude could give rise to a certain delay of the minute hands, but the regulation of the setting of the time is quick and easy.

BRIEF DESCRIPTION OF THE SEVERAL VIEWS OF THE DRAWINGS

The invention will be better explained with the aid of the description of special or preferred embodiments, with reference to the attached drawing in which:

FIGS. 6AA and 6AB show details of the behavior of the gearing;

DETAILED DESCRIPTION OF THE EMBODIMENTS

Figure 1:
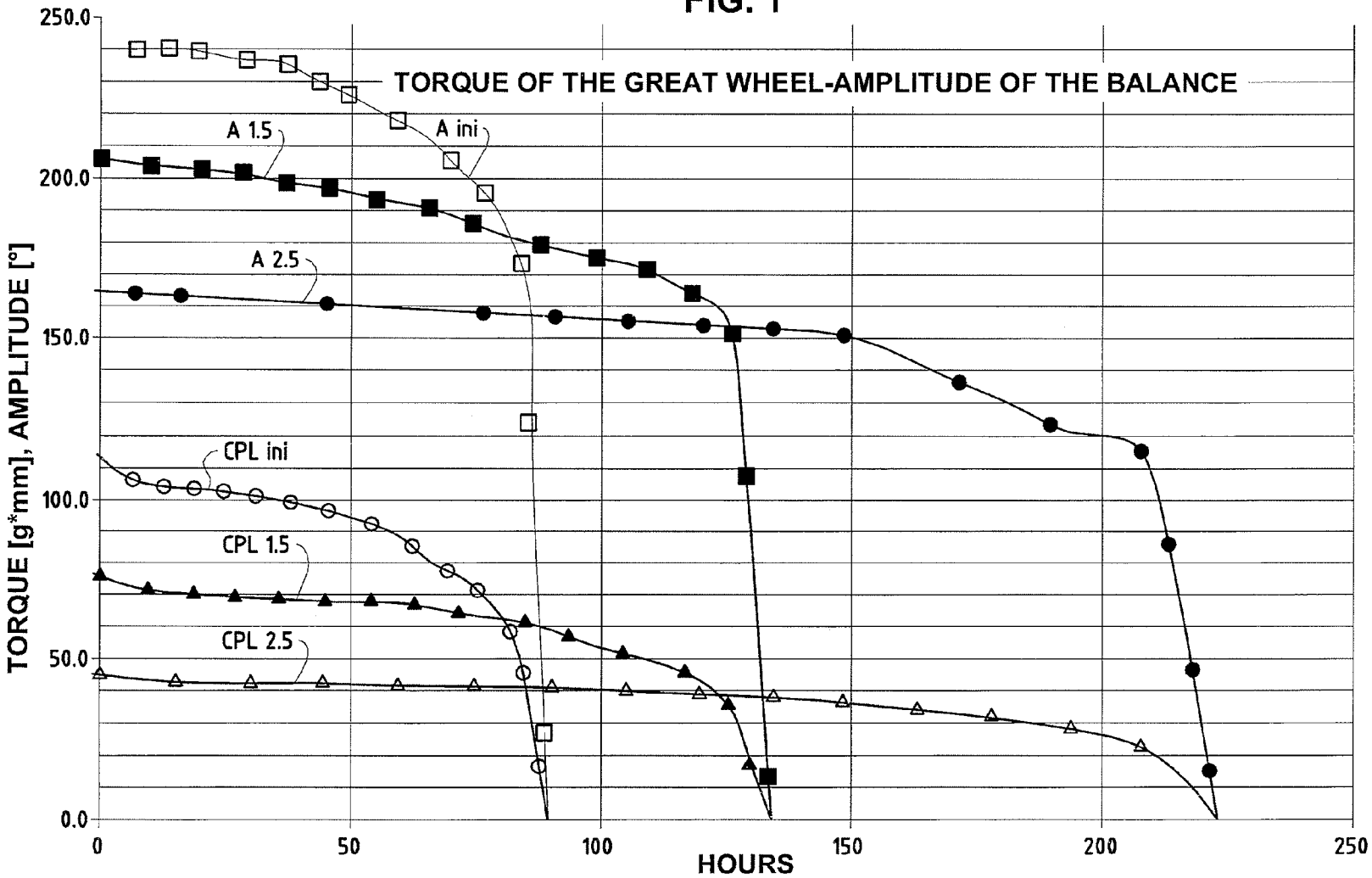
FIG. 1 is a diagram showing the torque and the amplitude of the balance with respect to the hours of operation of a timepiece movement.

FIG. 1 is a diagram which shows the relationship between the torque in g·mm on the great wheel, provided by the barrel, and the hours of operation of the timepiece movement after a winding of the watch spring. The ordinate of the diagram likewise shows the angle of oscillation of the balance in degrees. The necessary measurements have been made by the patent application holder on one of their calibers.

During normal operation, the torque provided is then 112 g·mm (curve CPL ini) and the amplitude of the balance is 240° (curve A ini); the watch stops after 90 hours of operation. When an increased speed ratio is introduced between the barrel and the great wheel (GM), for example with a multiplication of 1.5 times, the torque then falls to 75 g·mm and the amplitude of the balance to 205°; the operation lasts already for 135 hours. These conditions are represented by the curves CPL 1.5 (for the torque) and A 1.5 (for the amplitude of oscillation of the timepiece movement).

Finally, by applying a multiplication of 2.5 times, an initial torque is measured of 45 g·mm and an amplitude of the balance of 165°. This movement then has an operational reserve of approximately 225 hours, measured until the total stop of the movement, but a usable reserve of 200 hours; see the curves CPL 2.5 for the torque and A 2.5 for the amplitude of the balance.

An in-depth analysis of the conditions of this trial gives the following data: The torque necessary for driving a perpetual calendar (QP) is 3.05 g·mm. However, for all the configurations envisaged, the available torque for the entire operational reserve is greater than 10 g·mm.

For the configurations having a multiplicative ratio, it is necessary to take into account the efficiency of the mechanism. By basing it on an efficiency of 40%, which is more than pessimistic (efficiencies of about 80% have been measured and calculated), one always has sufficient torque for driving the perpetual calendar (QP).

By considering a possible delay in the timepiece movement in the entire course of operation, it has been noted that a passage of the amplitude of the balance from 250° to 120° would have as an impact a daily loss on the order of 20 seconds, and a passage from 180° to 85° generates a loss on the order of 26 seconds. The measurements of the torques have been carried out with the aid of a variocouple apparatus of the company CSA Instruments S.A., Peseux, Switzerland.

Thus, if the mechanism envisaged has the reserve for operation of a watch for one week, or even more, there would result in a loss of some minutes at the utmost. The user would find the watch in a state of operation, calendar indications up-to-date, and would have to carry out a correction of the time by some minutes, a procedure considerably more simple than resetting the date of a perpetual calendar.

Three embodiments are presented in the following for realization of the construction of a timepiece movement according to the invention. Involved in these three embodiments is implementing a change in the speed ratio between the barrel and the center wheel.

Figure 2B:
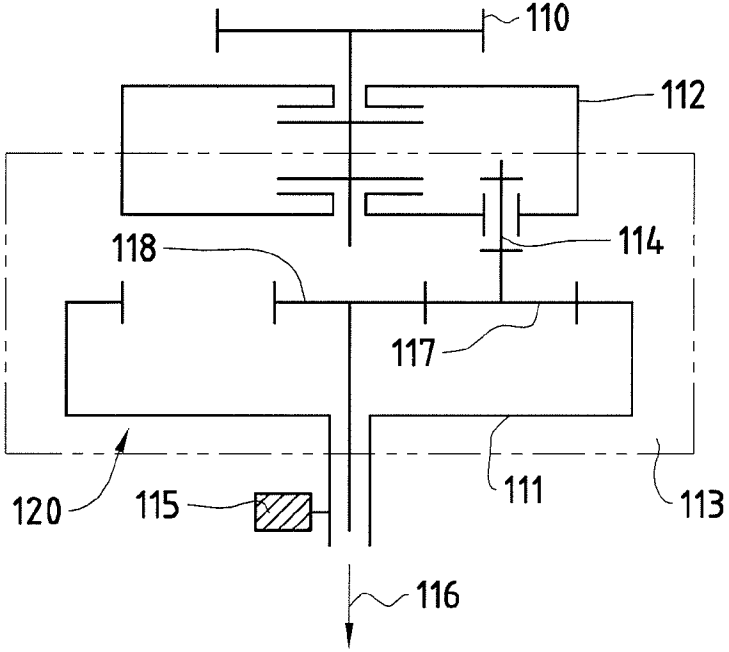
FIG. 2B shows the principle of an operational mode with reduced exit torque of the timepiece movement of FIG. 2A.
Figure 2A:
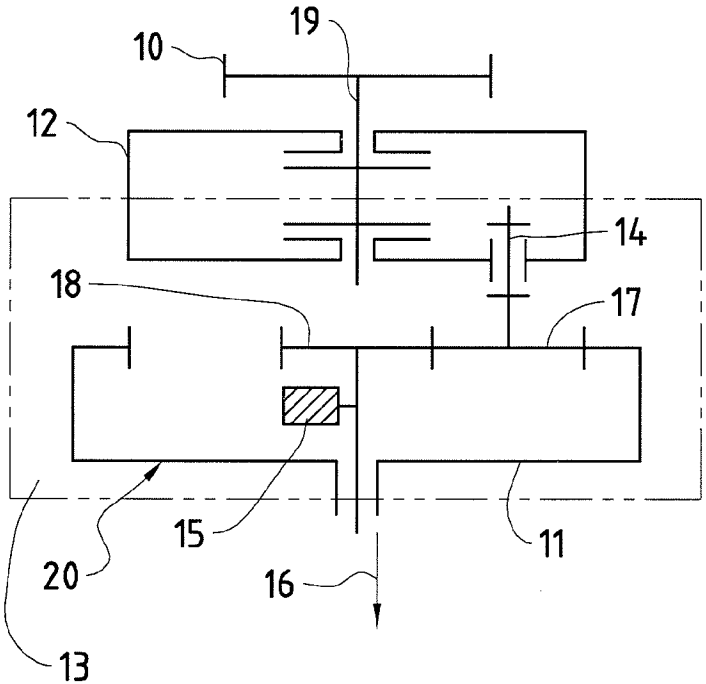
FIG. 2A shows the principle of a normal mode of operation of a timepiece movement around the barrel.

FIG. 2A shows, first of all, the principle of the normal mode of a conventional gearing of a timepiece movement. One discerns the ratchet wheel 10 with its arbor 19 which traverses the barrel 12. The exit arbor 14 of the barrel supports a planet gear 17 of a planetary train 20 composed of a crown 11, a central pinion (sun gear) 18 and several planet gears 17, of which just one is represented. In this configuration, the arbor of the central pinion is fixed with respect to the movement by the fixation element 15, and the exit 16 of the gearing is constituted by the crown 11.

The low energy feed embodiment is represented in FIG. 2B. The parts are the same as those of FIG. 2A, and their reference numerals are increased by 100; for example the ratchet wheel 10 in FIG. 2A is the ratchet wheel 110 in FIG. 2B. In contrast, in this configuration, the crown 120 is blocked by the fixation element 115, and the planet gear 117 transmits its force directly to the central wheel 118, the arbor of which forms the exit 116. Obtained rather simply through this change in the functioning of the gearing is a reduction in the ratio between the barrel and the great wheel comprising between 1.25 and 5, depending upon the number of teeth of the engaged wheels. This change of ratio has as an effect a multiplication of the speed of exit, thus a reduction of the torque transmitted to the balance.

However, a drawback of this embodiment of low energy feed operation is that the exit of the planetary train 20 is different depending upon the mode of operation. Of course, a technical solution is available for bringing the exit of the train on a same axis, but this increases the number of parts and thus the cost as well as the bulkiness of the device.

Figure 3:
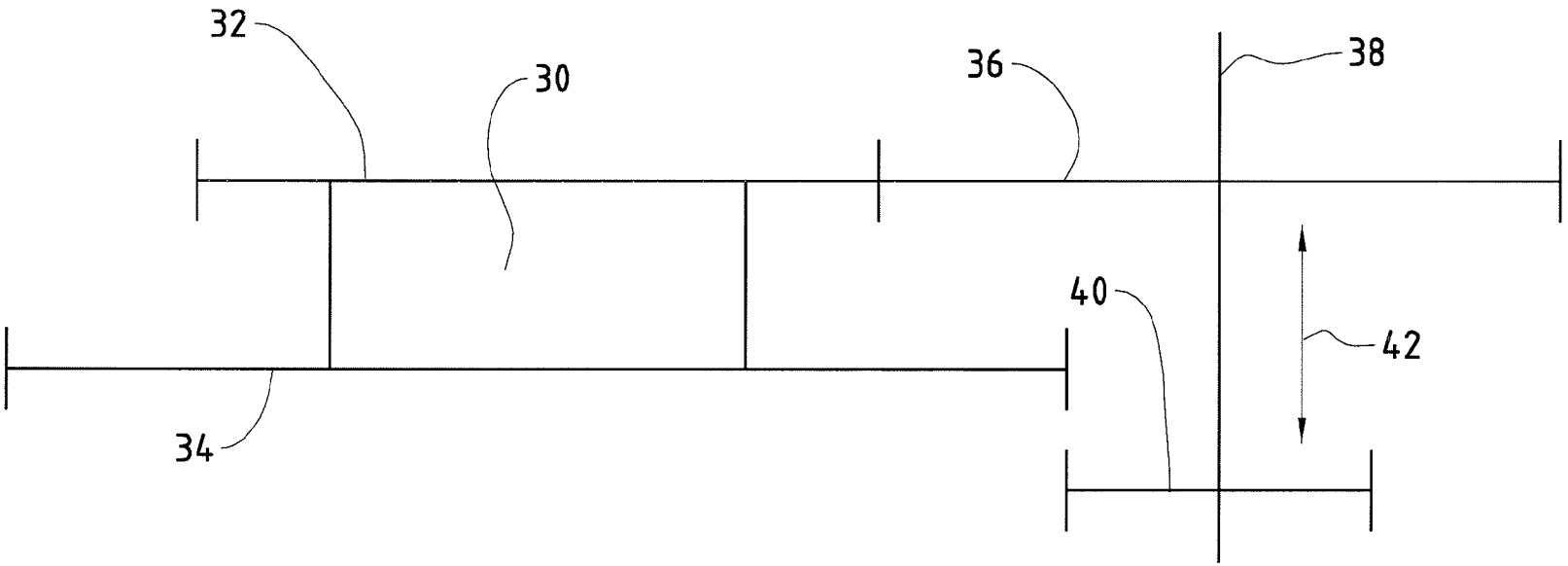
FIG. 3 shows another principle of change between a normal operational mode and an operational mode with reduced exit torque.

A second main embodiment for changing the torque provided by the watch spring is represented in FIG. 3. The barrel 30 bears two wheels, a relatively small wheel 32 on its upper face, and a relatively large wheel 34 on its lower face, the planes of the two wheels being parallel. The wheels 32 and 34 are able to engage themselves alternately in the two central wheels or pinions 36 or 40, respectively, central wheels 36 and 40 both fixedly attached to a common arbor 38, with a vertical spacing between wheels 36 and 40 being a little greater than the vertical distance of the two toothed wheels 32 and 34 of the barrel. This arbor 38 is able to be displaced vertically as indicated by the arrow 42.

In the normal mode, the small wheel 32 is engaged with the large wheel 36 of the center. When the wheel and pinion subassembly 36, 38, 40 is lifted as indicated by the arrow 42, the large wheel 36 of center disengages from small wheel 32 of barrel 30, and the small wheel 40 of the center engages itself with the large wheel 34 of the barrel 30. Of course the multiplication ratio 32/36 then becomes a multiplication ratio 34/40 which is higher and has as an effect a longer duration of the operational power reserve.

FIG. 3 is only schematic. Any other ratio between the four wheels concerned would be possible.

Figure 4B:
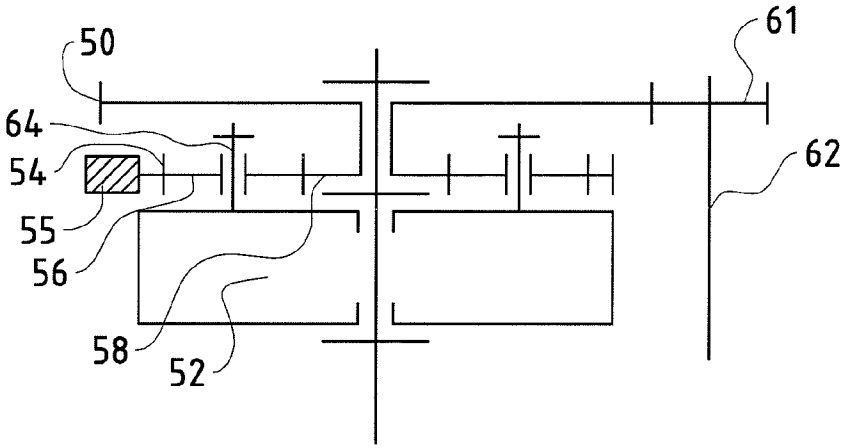
FIG. 4B shows the principle of an operational mode with reduced exit torque of the timepiece movement of FIG. 4A.
Figure 4A:
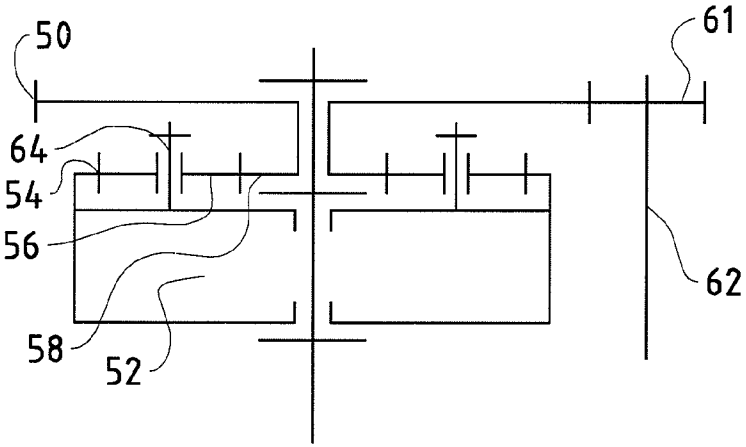
FIG. 4A shows a third principle of a normal operational mode of a timepiece movement around the barrel.

FIGS. 4A and 4B show a third main embodiment for changing the torque provided by the watch spring. The gears used are all shown schematically.

With respect to, FIG. 4A, a barrel 52 has on its upper part a toothing 50 which is able to transmit a movement through the agency of the wheel 61, which is integral with a shaft 62, to the central wheel and pinion (not shown). A planetary gearing made up of a crown 54, planet gears 56 (of which only one is shown) and a sun gear 58 is inserted between the barrel 52 and the toothing 50.

In the arrangement of FIG. 4A, which represents operation in the normal mode, the toothing 50 of the barrel and the sun gear 58 are integral, the crown 54 of the barrel is integral with the barrel 52, and the planet gear 56 pivots on a shaft 64 integral with the barrel 52. In this configuration, when the barrel unwinds itself, the planet gear 56 is not able to turn about its axis of rotation. Therefore everything happens as if the elements 54, 56 and 58 were integral, and they thus all turn at the same speed as the barrel 52. The planetary train is then completely invisible. The toothing 50 of the barrel 52 thus also turns at the same speed as that of the barrel.

FIG. 4B shows a diagram of operation in low energy feed mode and is based on FIG. 4A. The crown 54 is blocked, which is symbolized by the stud 55. In this configuration, the crown 54 of the barrel 52 is no longer integral with the barrel 52, but is fixed (to a bridge or to a plate). When the barrel unwinds itself, it forces the planet gear 56 to roll on the crown of the barrel 54. In its movement, the planet gear 56 will drive in rotation the sun gear 58 at a speed of rotation greater than that of the barrel 52, in accordance with the dimensioning of the planetary train. The speed ratio multiplier of the planetary train will thus increase the power reserve and reduce correspondingly the torque transmitted to the central wheel and pinion.

Figure 5A:
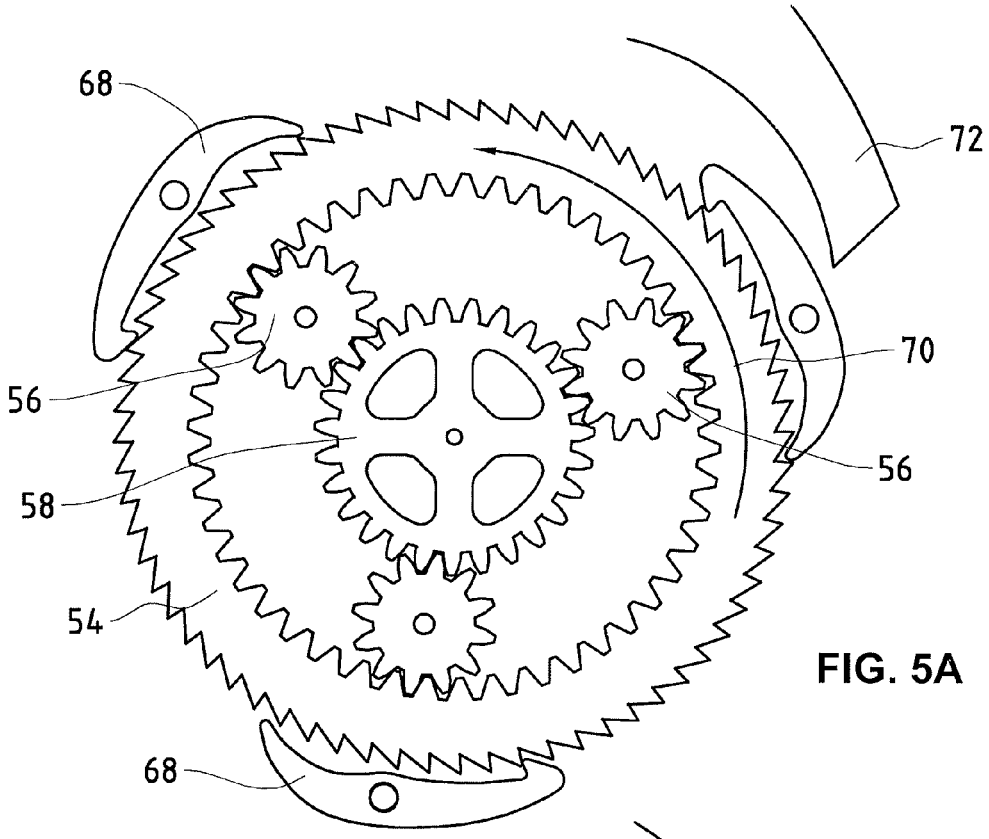
FIG. 5A shows schematically a first practical implementation of the device according to FIG. 4A.
Figure 5B:
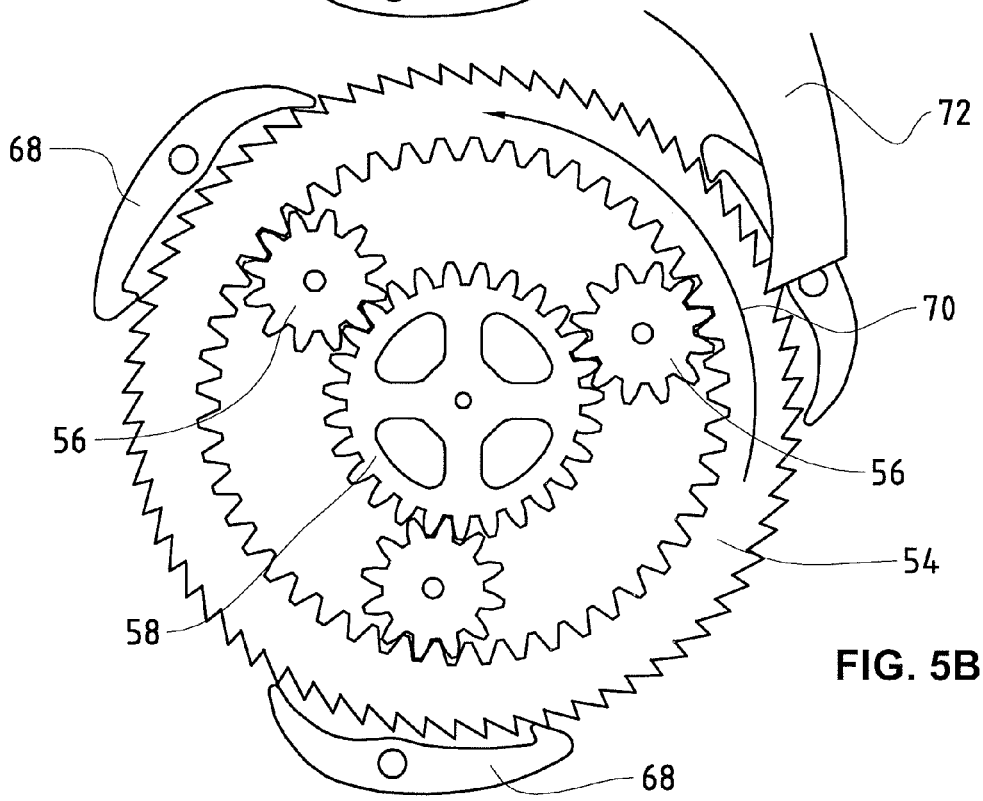
FIG. 5B shows schematically a first practical implementation of the device according to FIG. 4B.

FIGS. 5A and 5B illustrate a practical implementation of the third main embodiment for changing the torque provided by the watch spring. The gears used are represented only schematically.

With respect to FIG. 5A, which shows the operation of the timepiece movement in normal mode. Certain elements, familiar to one skilled in the art, are not represented such as the barrel 52 (see FIG. 4) and its toothing 50.

The crown of the barrel 54 has a triangular toothing on its largest diameter. This toothing will work with the pawls 68. The axes of rotation of the pawls 68 as well as of the planet gears 56 are integral with the barrel.

The crown of the barrel 54 is in pivot connection with the barrel. The central wheel and pinion, not shown, carries out one turn in one hour. For comprehension of the following explanations, we will consider it as immobile.

In this configuration, when the barrel unwinds itself (it is released), in the direction of rotation indicated by the arrow 70, it forces the planet gears to turn on the sun gear 58 which is immobile since it is engaged with the mobile of the center through the agency of the toothing of the barrel 50, see FIG. 4A. The planet gears 56 engage themselves with the crown of the barrel 54: as a result of the dimensioning of the planetary train; the speed of rotation of the crown 54 will be greater than that of the barrel 52. Therefore the triangular toothing of the crown 54 will block itself in an end of a pawl 68.

Starting from this state, the pawls 68, the crown of the barrel 54 as well as the planet gears 56 are immobile with respect to the barrel 52. The planetary train becomes invisible, the crown 54 also turns at the same angular speed as the barrel 52.

It should be mentioned that the time of blockage of the crown 54 on the barrel through the agency of the pawls is very short: it corresponds to one relative displacement of the crown with respect to the barrel by a third of the angular pitch of the triangular toothing.

Reference is now made to FIG. 5B, which shows the operation in low energy feed mode.

In this configuration, the control finger 72 immobilizes the crown 54 of the barrel 52. When the barrel unwinds itself, it forces the planet gears 56 to roll on the crown 54 of the barrel. In this movement, the planet gear 56 will drive the sun gear 58 in rotation at a speed of rotation greater than that of the barrel 52 (in accordance with the dimensioning of the planetary train). The pawls 68 oscillate slightly on the triangular toothing of the crown 54, and have no function.

FIGS. 5A and 5B show 3 planet gears: just 1 or 2 are necessary.

This embodiment is less cumbersome or bulky than the first embodiment. The outer triangular toothing of the crown of the barrel thus co-operates with two separate elements: the control finger 72 for immobilizing it, and the pawls 68 for rendering the crown 54 integral with the barrel 52.

Figure 6A:
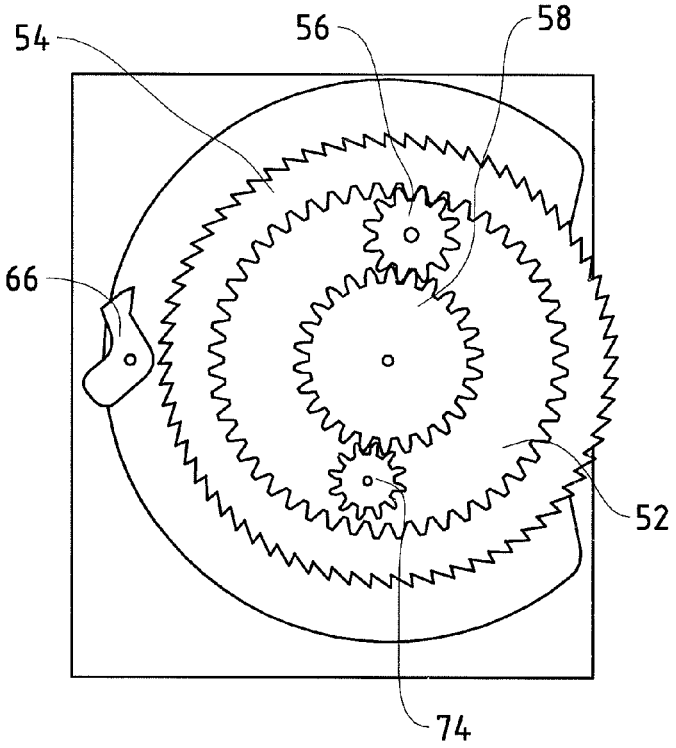
FIG. 6A shows schematically a second practical implementation of the device according to FIG. 4A.
Figure 6A:
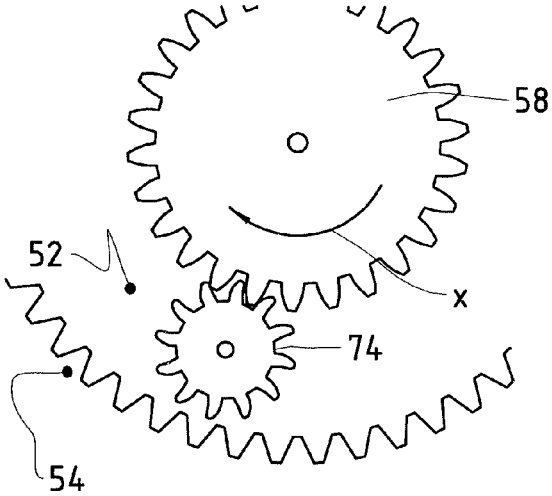
Figure 6A:
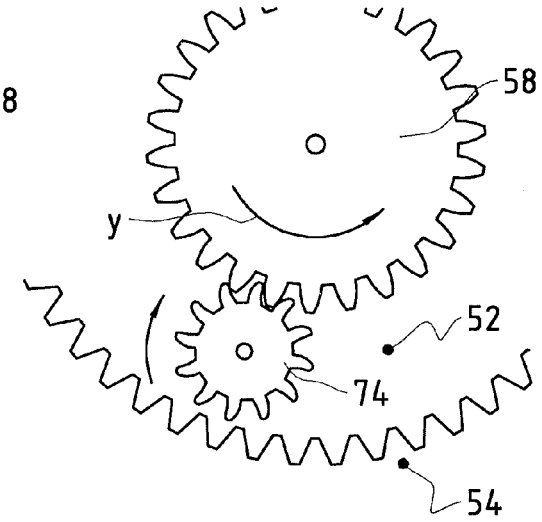

FIGS. 6A, 6AA, 6AB and 6B show a second practical implementation of the third embodiment for carrying out the invention which is based on FIGS. 4A and 4B.

First of all FIG. 6A is referred to, which illustrates the mode of normal operation of the timepiece movement. The gearing comprises a barrel crown 54, a planet gear 56, a sun gear 58, a control finger 66 and a barrel 52. In addition, a unidirectional pinion 74 is provided, which is engaged with the sun gear 58.

The crown of the barrel 54 is in pivot connection with respect to the barrel 52, as in the embodiment according to FIGS. 5A and 5B. The shafts of the planet gear 56 and of the unidirectional pinion 74 are integral with the barrel 52. The sun gear 58 can be considered as immobile, to simplify comprehension of the mechanism.

When the barrel unwinds itself, it forces the unidirectional pinion 74 to turn on the sun gear 58. The geometry of this pinion tolerates only one direction of rotation of the gearing; these conditions are represented summarily in FIGS. 6AA and 6AB. It can be seen in FIG. 6AA that the sun gear 58 turns in the direction of the hands of a watch, according to the arrow X, and it is blocked by the toothing of the unidirectional pinion 74. In this configuration, there is one blocking direction: starting from that state, the unidirectional pinion 74, the crown 54 and the planet gear 56 are immobile with respect to the barrel 52. The planetary train becomes invisible, and the crown 54 also turns at the same angular speed as the barrel 52.

In contrast, FIG. 6AB shows that the sun gear 58 turns in the other direction with respect to FIG. 6AA, and in this configuration, one rotation of the planetary train is possible because the unidirectional pinion 74 can be driven, and this rotation is transmitted via the planet gear 56 to the crown 54, which then turns less quickly than the barrel 52.

Figure 6B:
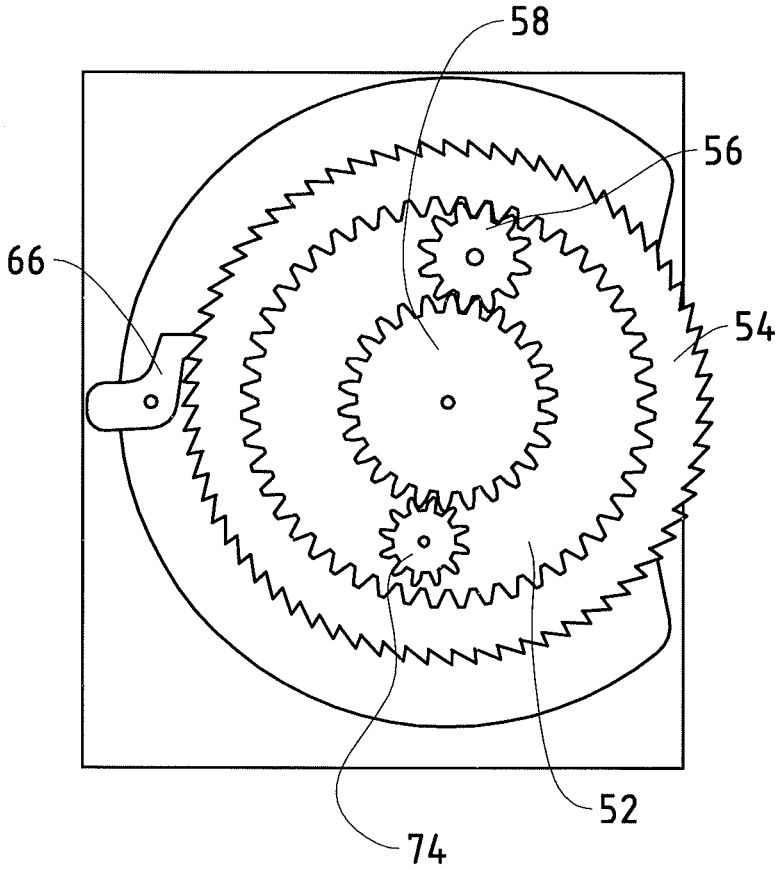
FIG. 6B shows schematically a second practical implementation of the device according to FIG. 4B.

FIG. 6B shows the operation of the timepiece movement in low energy feed mode. The control finger 66 immobilizes the barrel crown 54. In unwinding itself, the barrel 52 forces the planet gear 56 to roll on the crown of the barrel 54. In this movement, the planet gear 56 will drive the sun gear 58 in rotation at a speed of rotation greater than that of the barrel 52 (in accordance with the dimensioning of the planetary train).

The unidirectional pinion 74 turns in the void, and has no function. It is driven, but without effect.

This configuration has the advantage over the first embodiment (FIGS. 5A and 5B) that this solution requires fewer components, and that all the operations for passing from one mode to the other are achieved on the level of the planetary train. In the case of FIG. 5B, the finger 6 passes above the pawl 66, and needs to have two levels. The present solution thus contains fewer components and is less bulky.

Figure 7:
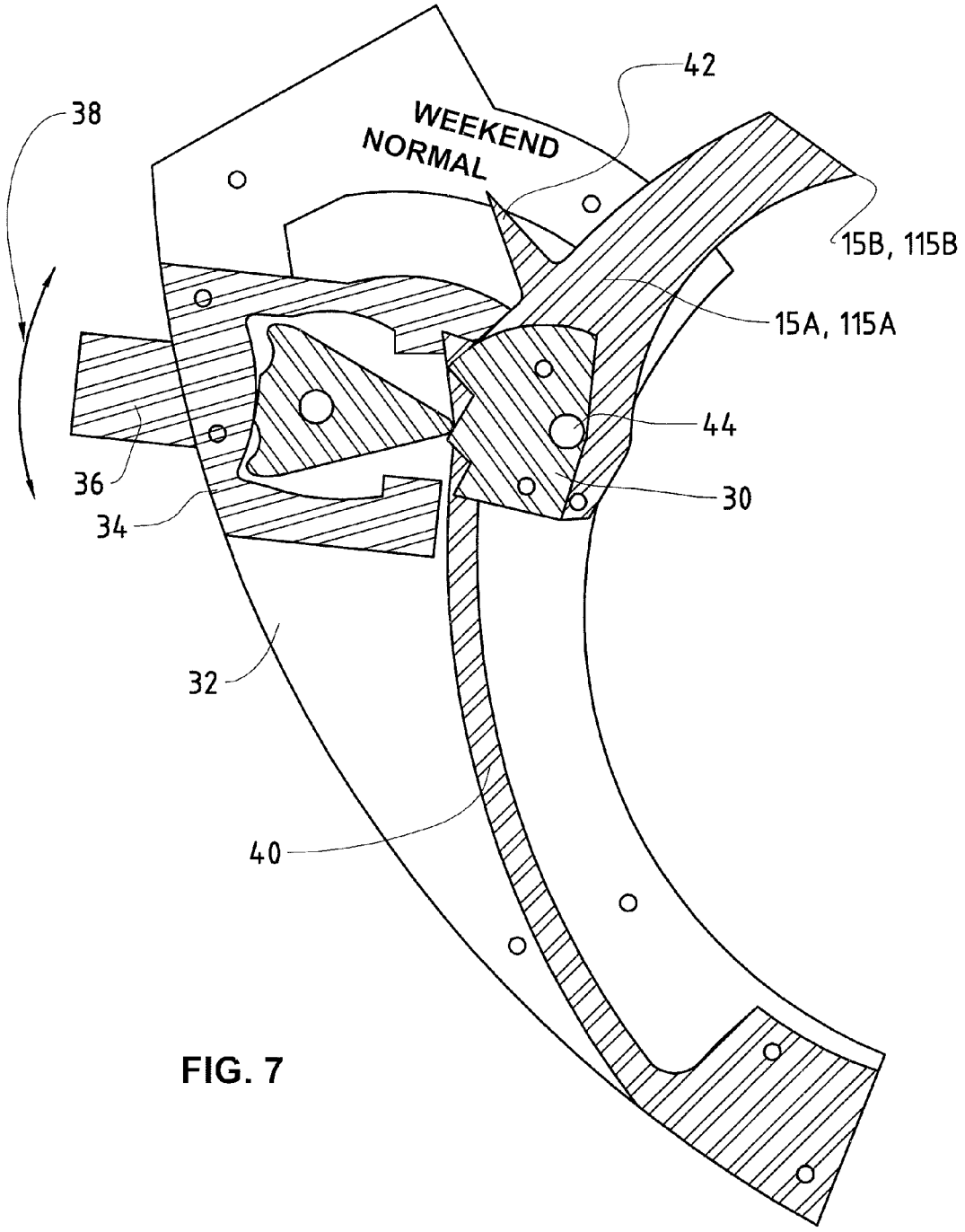
FIG. 7 is a schematic representation of a practical implementation of the switching between the normal mode and the reduced mode according to FIGS. 4A and 4B.

Another practical implementation of the switching between the normal mode and the low energy feed mode according to FIGS. 4A and 4B is represented in FIG. 7. Mounted in a pivotable fashion on a plate or bridge is a double tooth switch 80, integral with the pawl 15A, 115A. The pawl is loaded by a strip spring 88, which is retained in the selected position. The pawl comprises a pointer 90, visible from the exterior, which indicates the position of the selected pawl, or otherwise the normal operation ("NORMAL") or the operation with prolonged power reserve ("PROLONGED"). This position can be brought to final stop conditions by a lever 86, accessible from outside the watch, guided in translation on the plate 82. The finger 87, guided in rotation by the lever 86, co-operates with the planes 80A and 80B of the switching element 80 to carry out a change of state. The rotation of the finger 87 is limited by a frame 84, fixed on the plate 82.

As follows from the preceding, the invention provides a simple but effective system for prolonging substantially the operational power reserve of a mechanical watch. The invention can be applied in particular to simple mechanical watches, but also to watches with complicated functions, with calendar indications, chronographs, chronometers, etc.

This very thin, visible and distinguishable system, able to be integrated into all the aforementioned horological products, makes it possible to control the power reserve with respect to short or long duration, and the watch can pass the weekends, for example, without visible impairment and without the calendar not changing throughout the entire period of rest. The user has the choice of desired mode, and is informed by the watch about the selected mode. This change between normal mode and mode with extended power reserve can be manual or automatic.

Following the description above, a few observations should be added. In fact, when dimensioning the spring of the barrel, compromises are necessary between the features of the spring (bulkiness, variation of torque, number of turns of the winding) and the value of the power reserve. The patent application holder has shown that it is possible, with this device, to increase significantly the value of this power reserve: this criterion is thus no longer a constraint to be considered at the time of dimensioning of the spring of the barrel. The latter can be optimized in order to attain the desired performance of the movement.

The invention is not limited to the embodiments, described above and represented in the figures, of a timepiece movement with prolonged power reserve. Once the principles of the invention have been recognized, one skilled in the art will be able to find a suitable embodiment. Such an approach does not constitute a departure from the scope of protection conferred by this patent, the application of which is limited only by the content of the claims.

The invention claimed is:

1. A mechanical timepiece movement, comprising:

a spiral spring;

a barrel, the spiral spring accommodated in the barrel as an energy storage, the barrel transmitting energy of the spiral spring by a gear train to an oscillator, the oscillator including a balance as a regulating device; and a mechanism configured to reduce a torque generated by the barrel to reduce loss of energy stored in the spiral spring.

2. The mechanical timepiece movement according to claim 1, the mechanism comprising:

a plurality of planetary gears arranged between the barrel and the gear train, a reduction rate of a gearing of the plurality of planetary gears being modifiable to reduce the torque provided by blocking at least one of the planetary gears in order to change the torque provided by the barrel.

3. The mechanical timepiece movement according to claim 1, the mechanism comprising:

a first barrel wheel arranged on an upper face of the barrel;

a second barrel wheel arranged on a lower face of the barrel, the first barrel wheel having a different diameter than the second barrel wheel;

a first follower wheel configured to engage with the first barrel wheel;

a second follower wheel configured to engage with the second barrel wheel, wherein either the first follower wheel is engaged with the first barrel wheel to provide a first torque generated by the barrel, or the second follower wheel is engaged with the second barrel wheel to provide a second torque generated by the barrel, the first torque being different from the second torque.

4. The mechanical timepiece movement according to claim 1, the mechanism comprising:

a planetary gear arrangement following the barrel, the planetary gear arrangement having a sun gear, a crown gear, and a planet gear, wherein a toothing of the barrel and the sun gear are rotatably fixed to each other, the crown gear is configured to engage and disengage with the barrel, and a planet gear is configured to pivot around an axis of rotation that is fixed to the barrel, wherein, in a low energy feed operation mode, the crown gear is not engaged to the barrel, and is at a fixed position, immobilizing the crown gear.

5. The mechanical timepiece movement according to claim 4, wherein the crown of the planetary gear arrangement has a triangular outer toothing configured to engage with a prawl, axes of rotation of the pawl and the planet gear being rotatably fixed to the barrel, and wherein, in the low energy feed operation mode, a control finger engages with the crown of the planetary gear arrangement, immobilizing the crown gear.

6. The mechanical timepiece movement according to claim 4, wherein the planetary gear arrangement further includes an unidirectional pinion engaged with the sun gear, and not engaged with an inner toothing of the crown, axes of rotation of the planet gear and of the unidirectional pinion being fixed to the barrel, and wherein, in the low energy feed operation mode, a control finger that is configured to engage and disengage with an outer triangular toothing of the crown is engaged with the outer triangular toothing to immobilize the crown, and the planet gear is configured to rotatably drive the sun gear at a higher speed of rotation than a speed of rotation of the barrel.

7. The mechanical timepiece movement according to claim 1, wherein the mechanism to reduce the torque is configured to perform a reduction of the torque by a ratio R, and thereby increasing an energy reserve of the energy storage by the ratio R.

8. A watch having the mechanical timepiece movement according to claim 1, wherein the mechanism to reduce the torque is configured to be accessible from outside of the watch, and is configured to be manually operated.

9. The mechanical timepiece movement according to claim 1, wherein the mechanism to reduce the torque is configured to be automatically operated.

10. A watch having the mechanical timepiece movement according to claim 1, further including an indicator configured to indicate whether the watch is in a low energy feed operation mode, or a high energy feed operation mode.

11. A method for ensuring prolonged operation of a timepiece movement following an extended power reserve, comprising:

determining a distribution of torques in the timepiece movement required for driving different timepiece movement elements;

selecting an element of the timepiece movement elements for which the torque needs to be reduced; and reducing the selected torque to a value thereby ensuring proper operation of the timepiece movement.

12. The method according to claim 11, wherein the step of determining the distribution of the torques is performed by a variocouple apparatus.

13. The method according to claim 11, wherein the step of reducing the selected torque is performed by a change in a gearing transmitting an energy from the barrel to the different elements of the movement.

14. The method according to claim 11, wherein the step of reducing the selected torque, the torque is reduced by a ratio R.

15. The method according to claim 11, wherein the step of reducing the selected torque is performed automatically or manually from the exterior of a watch, the watch including:

a casing;

a spiral spring and a barrel located inside the casing, the spiral spring accommodated in the barrel as an energy storage, the barrel transmitting energy of the spiral spring by a gear train to an oscillator, the oscillator including a balance as a regulating device; and a mechanism configured to reduce a torque generated by the barrel to reduce loss of energy stored in the spiral spring.

16. A mechanical watch, comprising:

a casing;

a spiral spring and a barrel located inside the casing, the spiral spring accommodated in the barrel as an energy storage, the barrel transmitting energy of the spiral spring by a gear train to an oscillator, the oscillator including a balance as a regulating device; and a mechanism configured to reduce a torque generated by the barrel to reduce loss of energy stored in the spiral spring.

* * * * *